US007730679B2

(12) United States Patent
Eckenswiller et al.

(10) Patent No.: US 7,730,679 B2
(45) Date of Patent: Jun. 8, 2010

(54) DRAIN FOR A DOOR OR WINDOW SASH OR FRAME

(76) Inventors: Edgar Grant Eckenswiller, 168 Bayview Avenue, Port NcNicoll, Ontario (CA) L0K 1R0; Richard O'Donnell, R.R.1, Palgrave, Ontario (CA) L0N 1P0

( * ) Notice: Subject to any disclaimer, the term of this patent is extended or adjusted under 35 U.S.C. 154(b) by 178 days.

(21) Appl. No.: 11/979,996

(22) Filed: Nov. 13, 2007

(65) Prior Publication Data

US 2009/0120005 A1 May 14, 2009

(51) Int. Cl.
*E06B 7/14* (2006.01)

(52) U.S. Cl. ..... 52/209; 49/408; 137/527.8

(58) Field of Classification Search ..... 52/208–209, 52/204.51, 204.52, 204.5, 214, 302.1, 312, 52/4, 504.52, 302.7; 108/24; 137/527.8; 49/408, 476.1; 160/44; 454/196, 227, 271, 454/276, 277, 347, 354, 367, 368; 34/235
See application file for complete search history.

(56) References Cited

U.S. PATENT DOCUMENTS 202,219 A * 4/1878 Belt ..... 137/527.8
1,780,492 A * 11/1930 Malm ..... 160/44
3,937,168 A * 2/1976 Doak ..... 114/183 A
4,003,171 A * 1/1977 Mitchell ..... 52/209
5,159,953 A * 11/1992 Sato et al. ..... 137/527.8
5,822,934 A * 10/1998 O'Donnell ..... 52/209
6,374,557 B1 * 4/2002 O'Donnell ..... 52/209
6,475,078 B1 * 11/2002 Borcherding ..... 454/259
6,789,359 B2 * 9/2004 Bauman et al. ..... 49/471
2004/0163342 A1 * 8/2004 Marks ..... 52/302.1

* cited by examiner

*Primary Examiner*—Robert J Canfield
(74) *Attorney, Agent, or Firm*—Arne I. Fors

(57) ABSTRACT

A water drain for insertion into a mating wall opening in an extruded, hollow door or window sash or frame comprises a round, rectangular or the like housing having at least one peripheral front flange defining a drain opening, a baffle extending downwardly from a housing top portion for partially closing an upper portion of the drain opening, and a flap having a lower planar rear surface and an upper planar front surface for opening and closing lower and upper portions of the drain opening. The planar lower rear surface portion of the flap is joined to the upper front surface portion by a pivot axis, the planar lower surface being disposed forwardly of the upper planar front surface whereby the flap tends to gravitate to an at-rest, closed, substantially vertical position.

1 Claim, 16 Drawing Sheets

DRAIN FOR A DOOR OR WINDOW SASH OR FRAME

BACKGROUND OF THE INVENTION (i) Field of the Invention

This invention relates to a window or door drain and, more particularly, relates to a water drain at the base of an extruded window or door sash or frame.

(ii) Description of the Related Art

Windows and doors having single or double pane construction typically comprise a sash perimeter surrounding the glass panes which is pivotally or slidably mounted within a frame. The interiors of the sash and frame, typically made from extruded plastics or metal alloys, are essentially hollow. Problems frequently arise from the collection of moisture within the sash and/or the frame and drain holes usually are provided to allow water to escape from the sash as it forms.

Closable drains for extruded plastic windows or sliding patio doors, for example, typically tend to jamb in a closed or an opened position because of the miniature size of the drains, thereby trapping rainwater or condensate within the window or door sash if jammed shut or allowing air to blow through if jammed open. This can result in a substantial decrease in thermal efficiency and, particularly in cold northern climates and hot southern climates, can result in high heating or cooling costs with substantial discomfort to the inhabitants.

It is difficult to manufacture and to install small, air-tight drains without misalignment or malfunction of the component parts due largely to the small size and light weight of the miniature drain closure flap. Also, surface tension caused by a film of moisture can lock the drain flap in a open position, allowing air to blow through the open drain and permitting insects to enter the sash or frame.

U.S. Pat. No. 5,822,934 issued Oct. 20, 1998 discloses a water drain for door or window sashes in which a pivotally-mounted closure flap is mounted at an at-rest closed position of about 45° to the horizontal.

It is a principal object of the present invention to provide a small, inexpensive and reliable water drain assembly for extruded window or door sash or frame assemblies in which a drain flap is pivotally mounted in a vertically at-rest closed position.

Another object of the present invention is the provision of a drain flap which is balanced to remain closed regardless of wind pressure while able to open against wind pressure to drain any water accumulated in a sash.

It is another object of the present invention to provide a small drain assembly having a variety of shapes including a round weeper assembly for ease of installation.

SUMMARY OF THE INVENTION

In its broad aspect, the water drain of the invention for insertion into a mating wall opening in an extruded, hollow door or window sash or frame comprises a round or rectangular housing having at least one peripheral front flange defining a drain opening for abutment against a wall of the sash or frame, said housing having a top wall portion and a bottom wall portion perpendicular to the front flange, and a pair of opposed side wall portions, a baffle extending downwardly from the housing top wall portion for partially closing an upper portion of the drain opening, means for securing the housing within the wall opening, and a flap having a lower planar rear surface and an upper planar front surface for opening and closing lower and upper portions of the drain opening, said planar lower rear surface portion being joined to the upper front surface portion by a pivot axis, said planar lower surface being disposed forwardly of the upper planar front surface whereby the flap tends to gravitate to an at-rest, closed, substantially vertical position, said flap having a lug extension at each end of the pivot axis for insertion into mating holes in said side wall portions of the housing for pivotal mounting of the flap in the housing drain opening, whereby the flap planar lower surface can pivot from a substantially vertical at-rest position upwardly to an open position. The means for securing the housing top wall in a sash or frame opening preferably comprises an elongated rib parallel to the front flange depending from each of the housing top and bottom wall portions for engaging the said wall opening. The housing may be rectangular, round or elliptical in shape.

BRIEF DESCRIPTION OF THE DRAWINGS

The drain assembly of the invention will now be described in detail with reference to the accompanying drawings, in which.

DESCRIPTION OF THE PREFERRED EMBODIMENT

Figure 1:
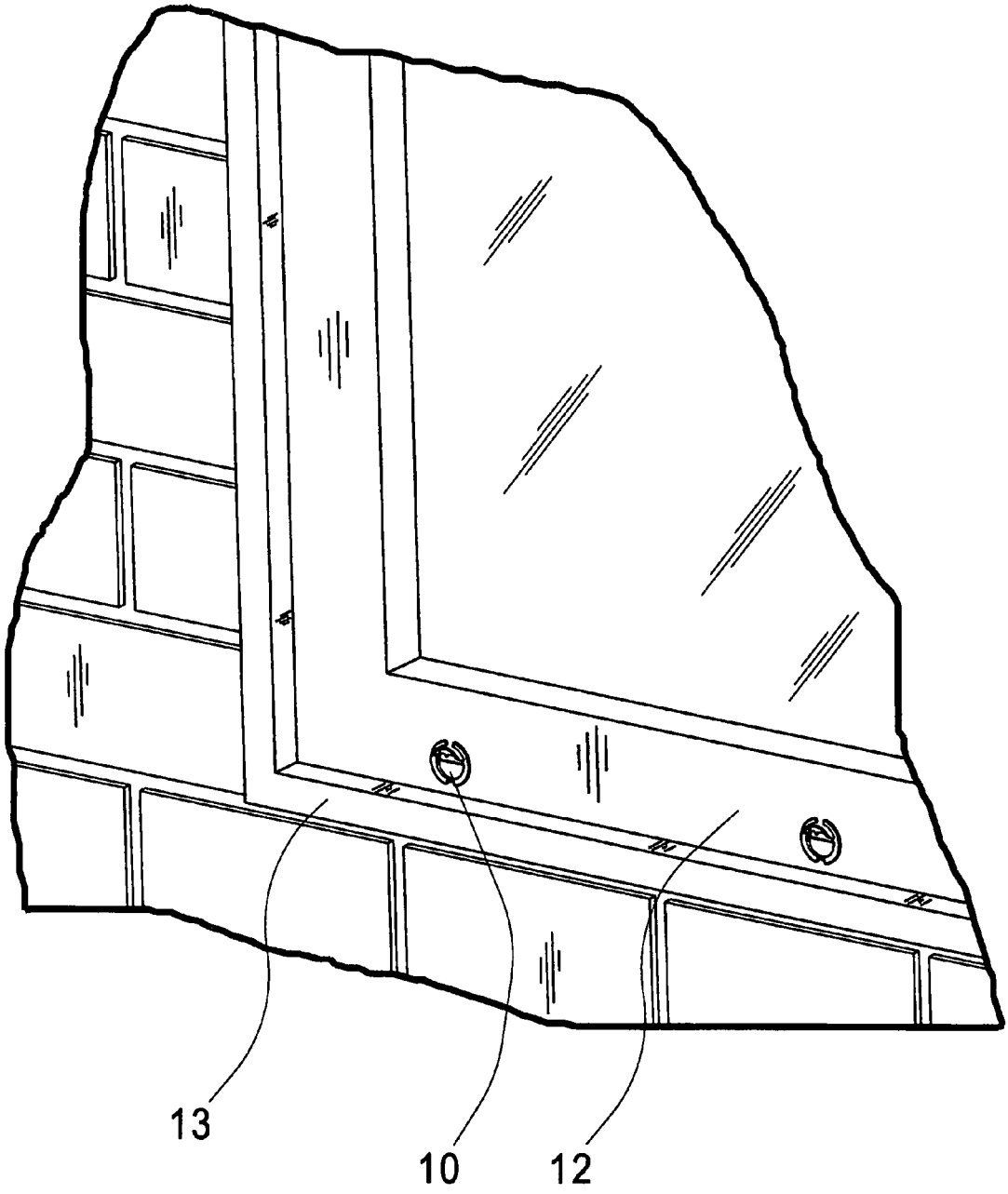
FIG. 1 is a perspective view, partly cut away, of a window or door sash having an embodiment of the drain of the present invention.

With reference to FIG. 1, a circular embodiment of the water drain 10 of the invention is shown installed in a window or patio door sash 12 slidably or pivotally mounted in a frame 13. It will be understood that although the description of the invention will proceed with reference to a window or door sash, the water drain of the invention can also be used in the hollow extruded frames for window and door sashes. Water collecting as a result of rain water leaking into the sash or condensate collecting within the sash drains by gravity to the base of the sash and is discharged through the drain.

Figure 2:
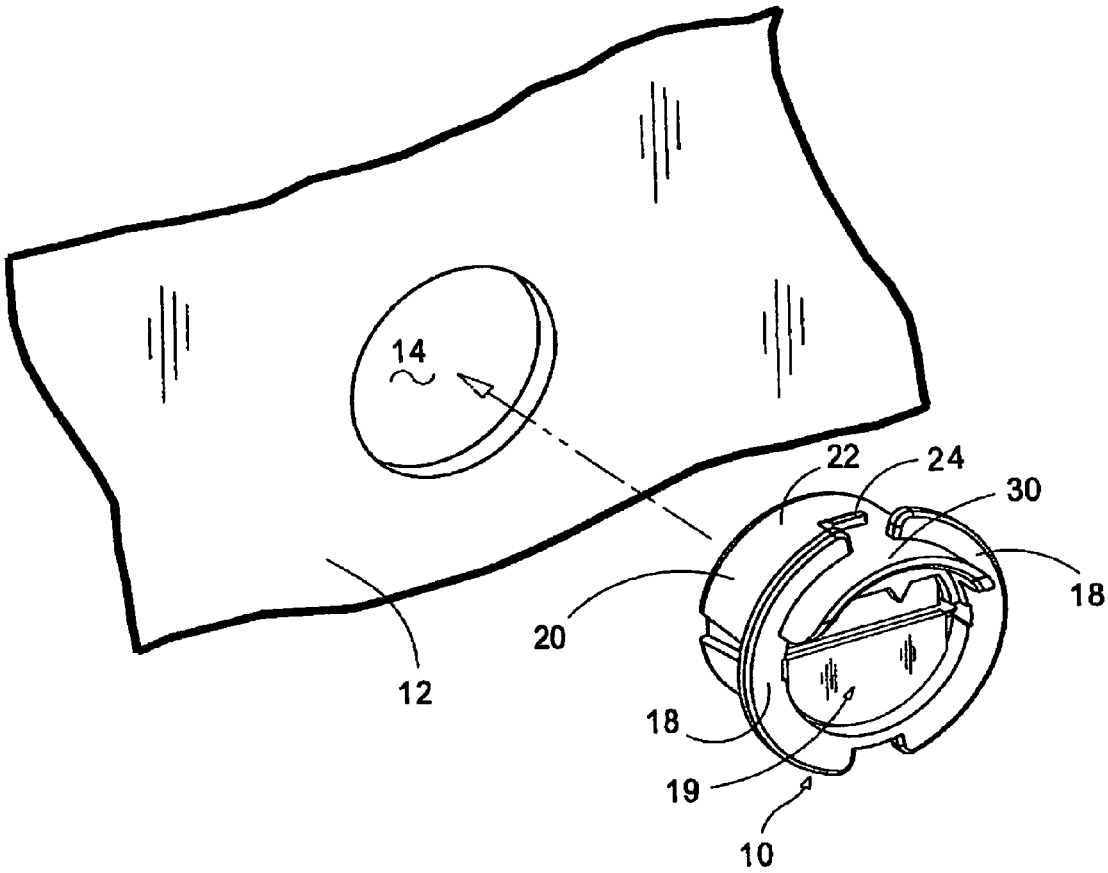
FIG. 2 is a perspective view showing the round drain embodiment of the invention shown in FIG. 1 preparatory to installation into a circular opening.
Figure 3:
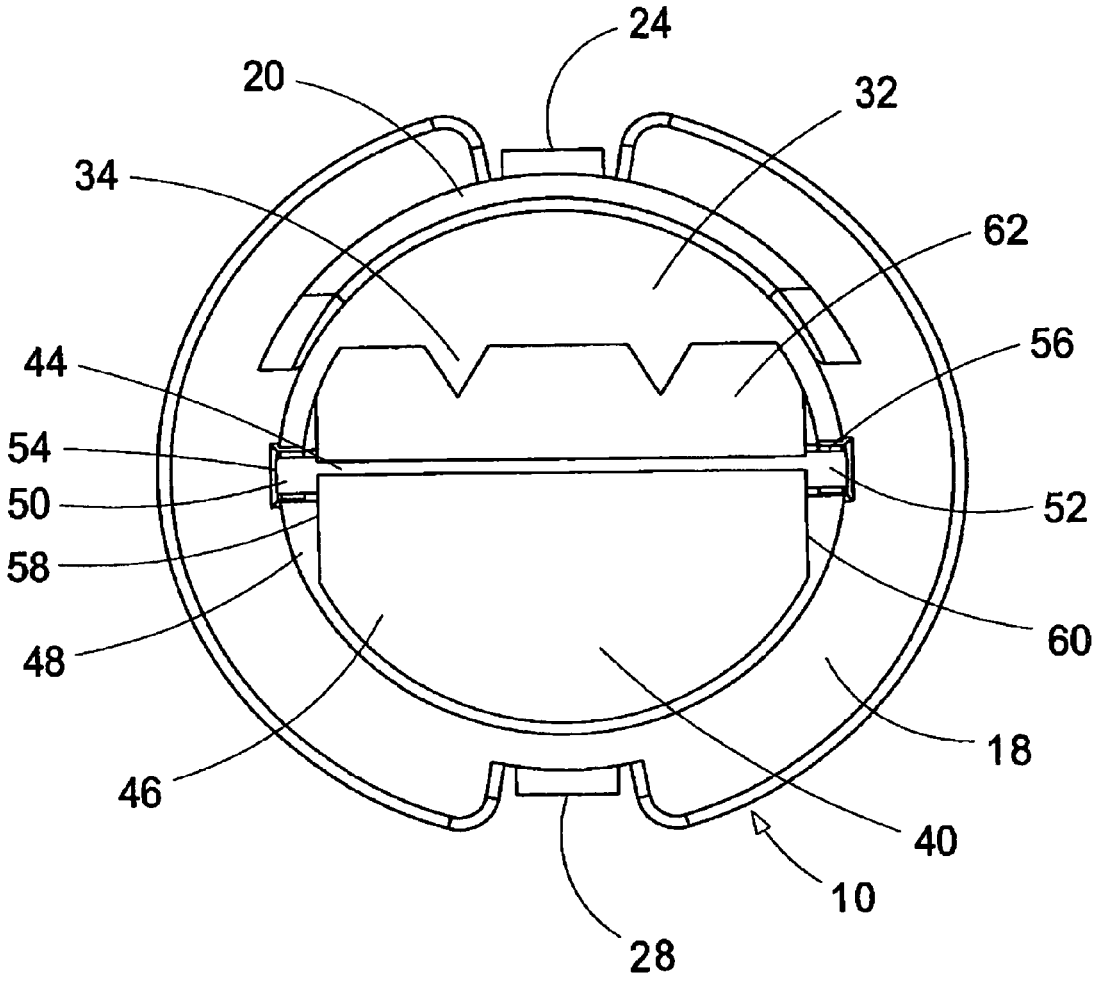
FIG. 3 is a front plan view of the drain in a closed position.
Figure 4:
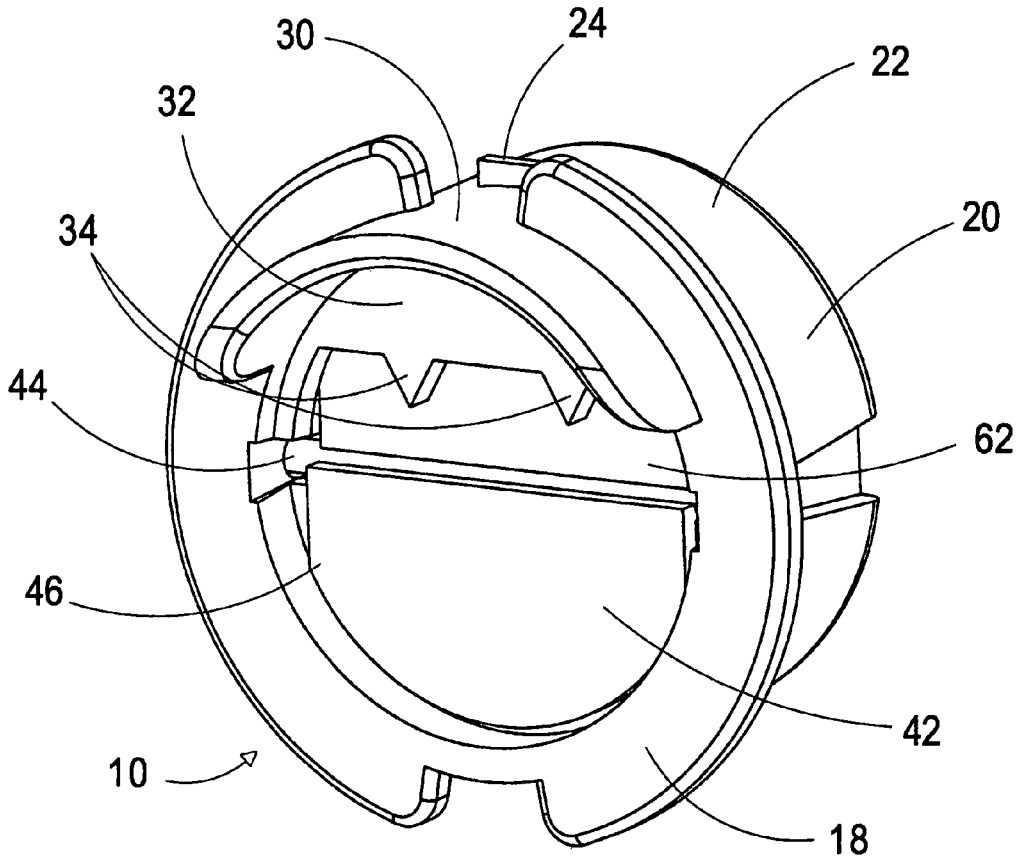
FIG. 4 is a front perspective view of the drain in a closed position.

FIG. 2 illustrates drain 10 preparatory to installation in a round hole 14 drilled in the thin wall of the sash 12. With reference to FIGS. 2-11, drain 10 has a front cover wall or flange 18 defining a front drain opening 19 formed integral with a rear round housing wall 20 by injection moulding of a plastics material such as nylon. The top 22 of wall 20 has an upstanding rib 24 and the bottom 26 has a rib 28 depending downwardly therefrom.

Round housing wall 20 is cylindrical in shape, preferably with a rain hood 30 extending forwardly as an extension of upper portion 22 of housing 20.

A baffle chord 32 is formed in the upper portion of housing 20 depending downwardly therefrom with V-shaped projections 34.

Figure 5:
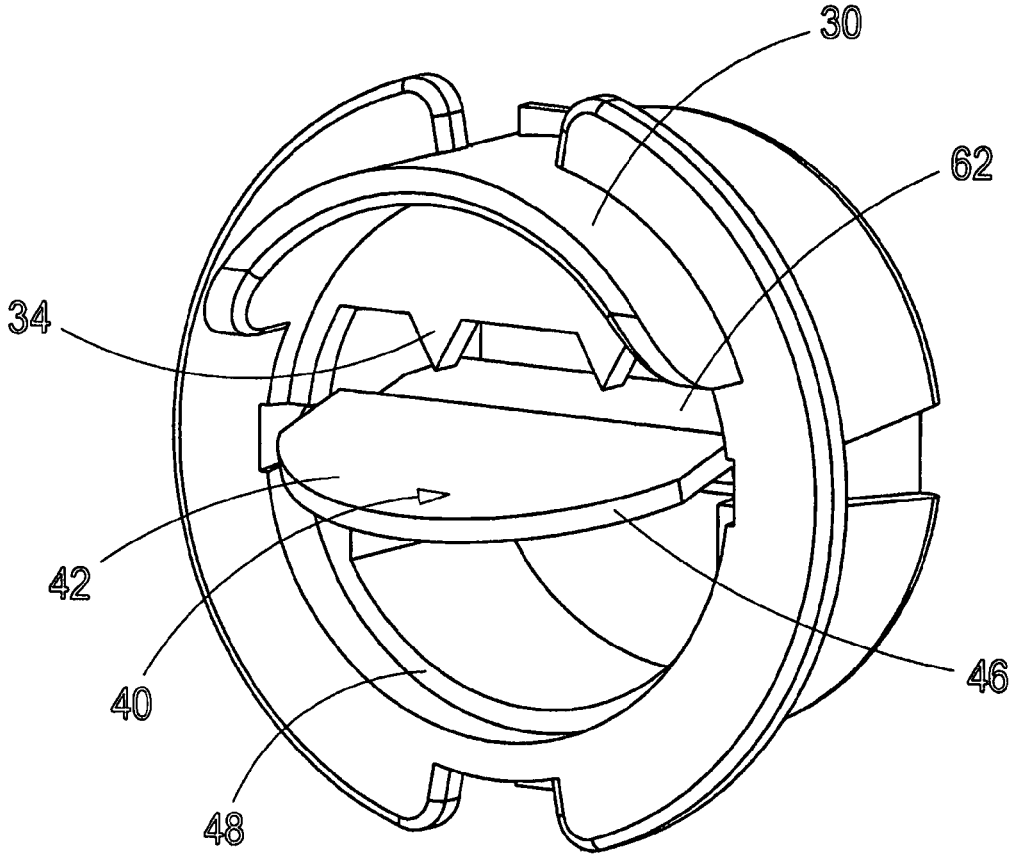
FIG. 5 is a front perspective view of the drain in an opened position.
Figure 6:
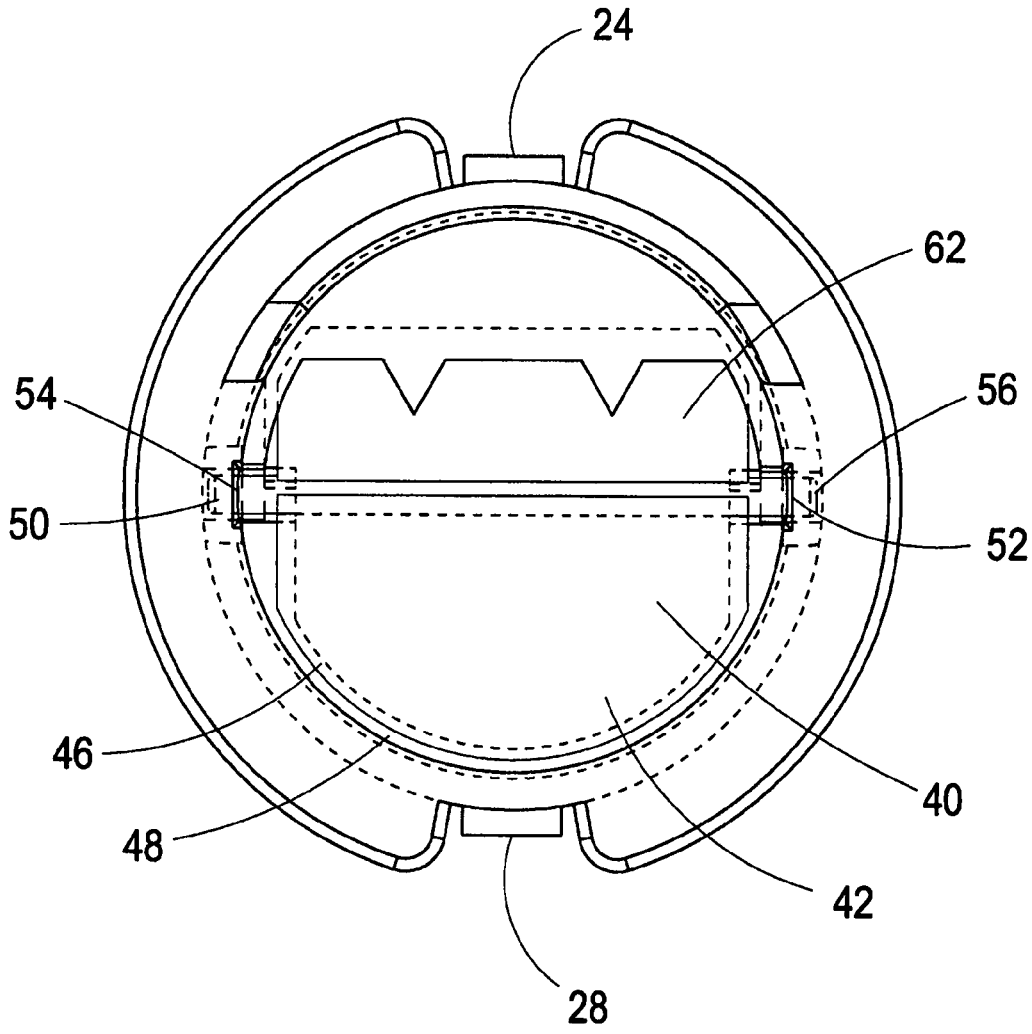
FIG. 6 is a front elevation view of the closed drain showing relationship of parts with broken lines.
Figure 7:
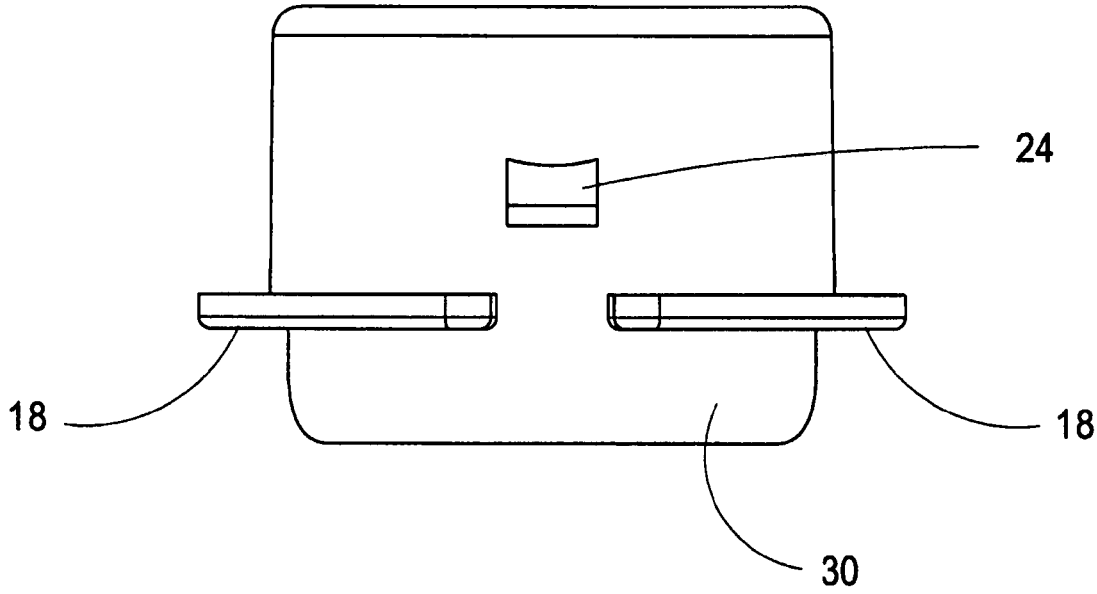
FIG. 7 is a top plan view of the drain.
Figure 8:
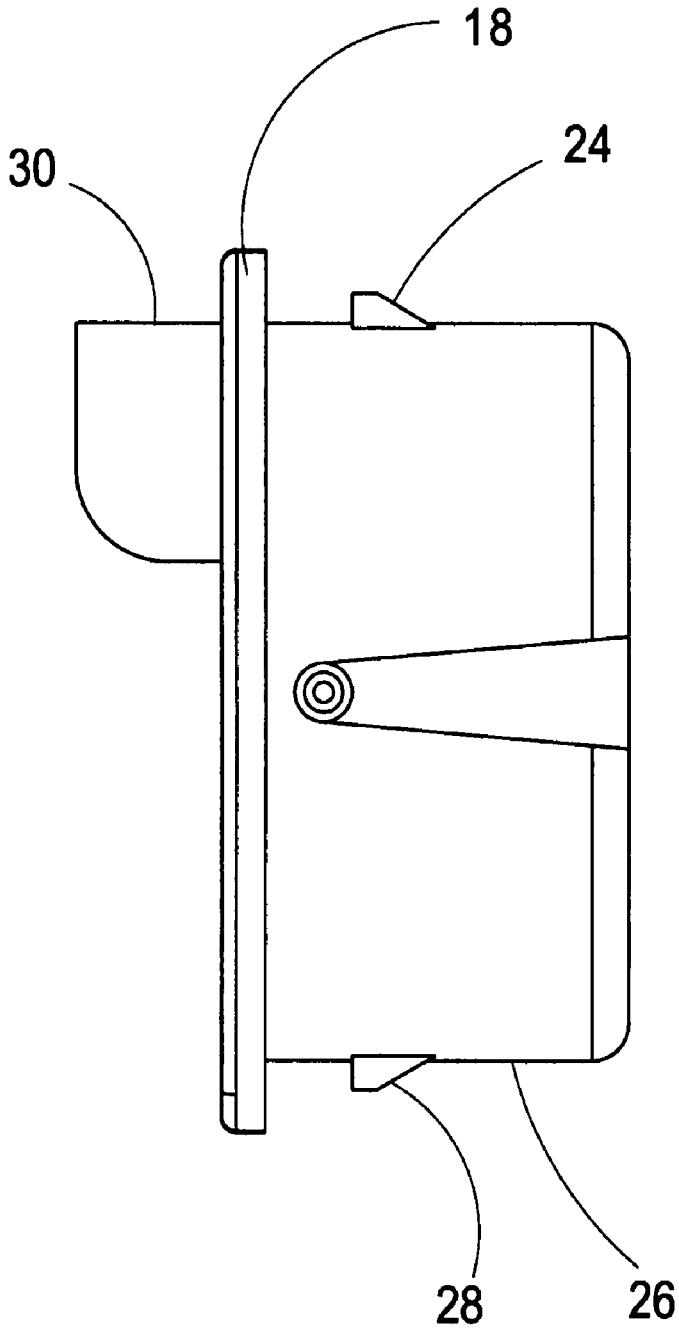
FIG. 8 is a side elevation view of the drain.
Figure 9:
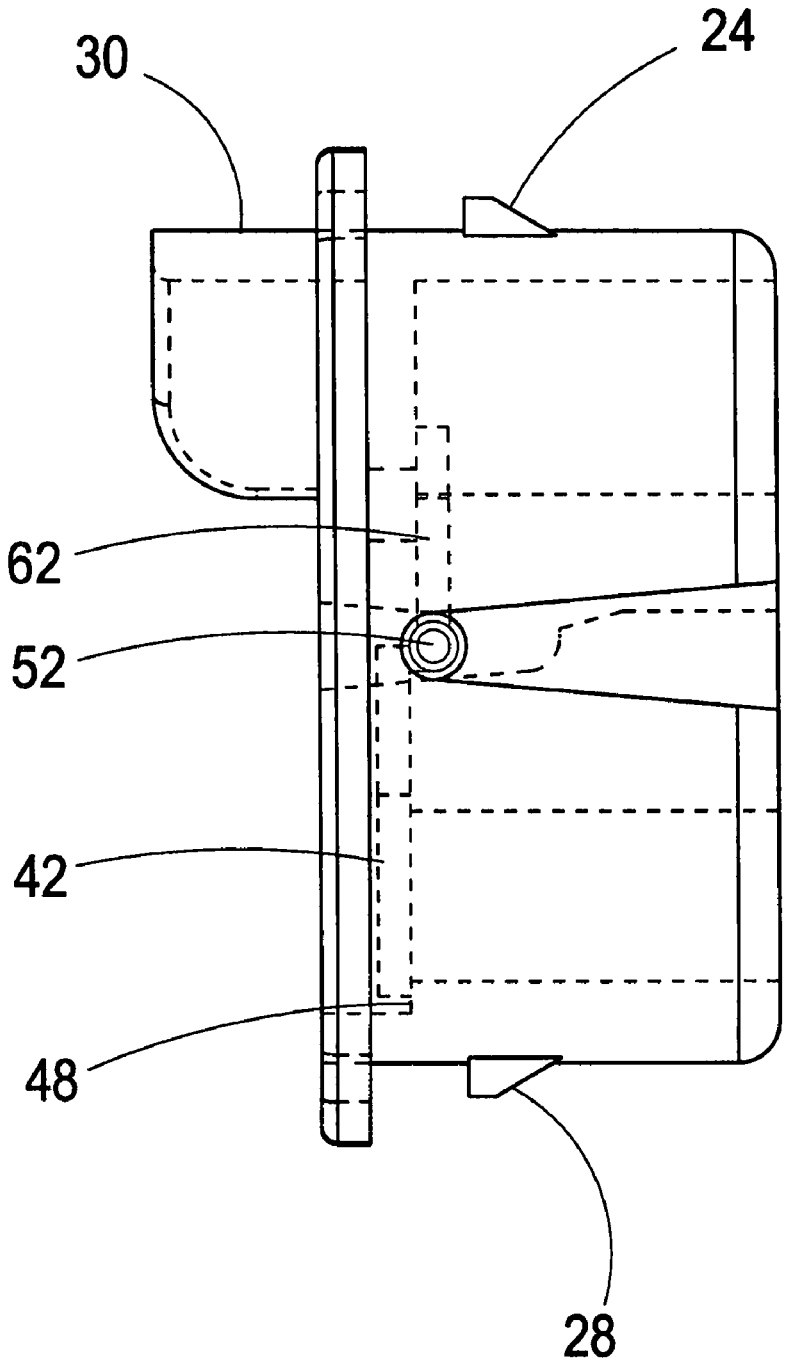
FIG. 9 is a side elevation view of the closed drain showing relationship of parts with broken lines.

Flap 40, preferably also injection molded from nylon, shown most clearly in FIGS. 5 and 6, has a circular lower portion 42 radially offset forward of transverse pivot axis 44 formed at the rear thereof diametrically across the center of circular portion 42. Circular lower portion 42, concentric with cylindrical housing 20, has a radius greater than the radius of cylindrical housing 20 whereby perimeter 46 of circular lower portion normally abuts the forward circular recessed edge 48 of housing 20, as shown most clearly in FIG. 10, to close the lower half of drain opening 19.

Cylindrical lugs 50, 52 formed at each end of pivot axis 44 are adapted fit into round mating holes 54, 56 formed at opposed sides of housing 20 for pivotal mounting of flap 40 therein. The opposite sides 58, 60 of flap 40 are flattened to permit the upper rectangular portion 62 of flap 40 to be inserted through frame opening 19, with rectangular portion 62 extending upwardly from central pivot axis 44 to abut the rear surface 66 of baffle 32, as shown most clearly in FIG. 10.

Figure 10:
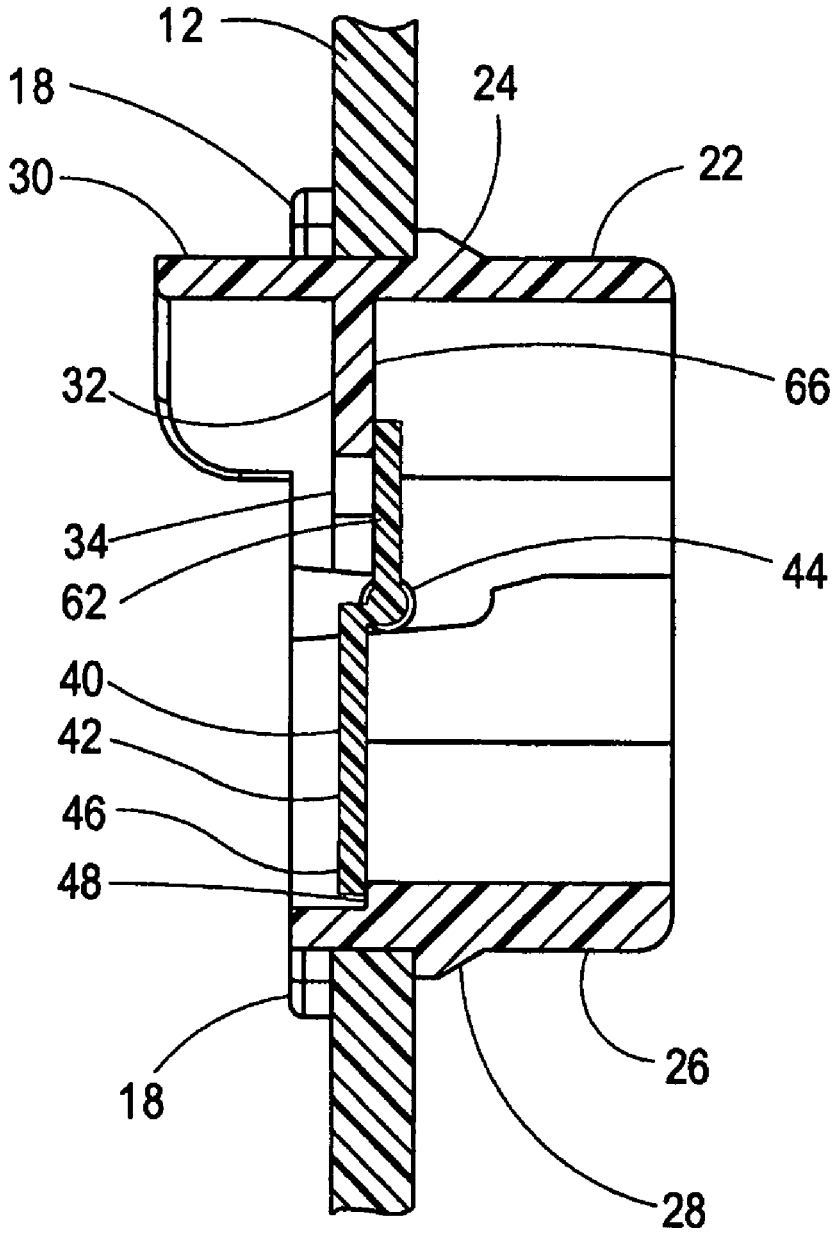
FIG. 10 is a vertical section of the drain with the flap in its closed position.
Figure 11:
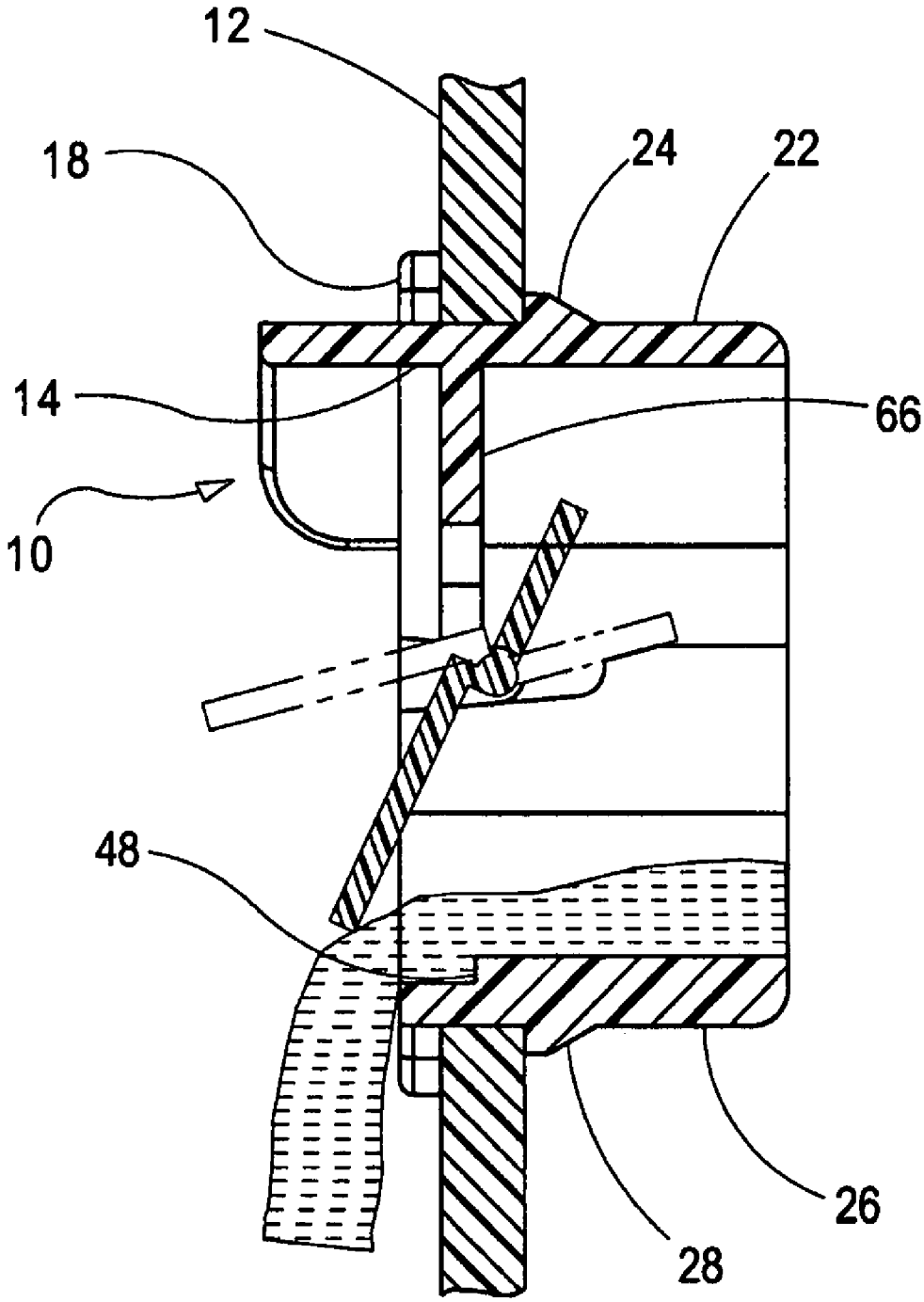
FIG. 11 is a vertical section corresponding to FIG. 10 in which the flap is shown in a partially open position, and shown in a fully open position by ghost lines, to allow the water to drain.

FIGS. 10 and 11 illustrate installation of drain 10 in opening 14 with the rear surface 36 of front cover wall 18 abutting sash 12. Upper rib 24 ensures a frictional locking engagement with the wall of the sash opening. Lower rib 28 abuts the lower edge of the wall of the sash opening for secure engagement therewith.

The round opening 14 is formed in the front lower face of a window or door sash or frame by drilling. The drain 10, having the flap 40 snap-fitted into housing 20, is inserted into the opening to the position as shown most clearly in FIGS. 10 and 11. In operation, in the absence of water in the interior of the sash 12, the flap 40 assumes the closed, substantially air-tight position shown in FIG. 10 by gravity, with the perimeter 46 of circular lower portion 42 abutting the recessed edge 48 of housing 20 and the upper rectangular portion 62 abutting the rear surface 66 of baffle 32. When pivoted to an open position as depicted in FIGS. 5 and 11, to allow the escape of water, V-shaped protrusions 34 prevent the ingress of insects. Upon completion of drainage of water, flap 40 pivots by gravity downwardly to its closed position.

It has been found that the use of a bottom flap portion larger than the top flap portion with a forward, radially-offset bottom portion, in combination with an upper opening baffle, provides a balance to the flap to allow the flap to open to drain water regardless of any wind pressure impressed on the flap. The flap remains closed or to pivot to a closed position when no water is present.

Figure 12:
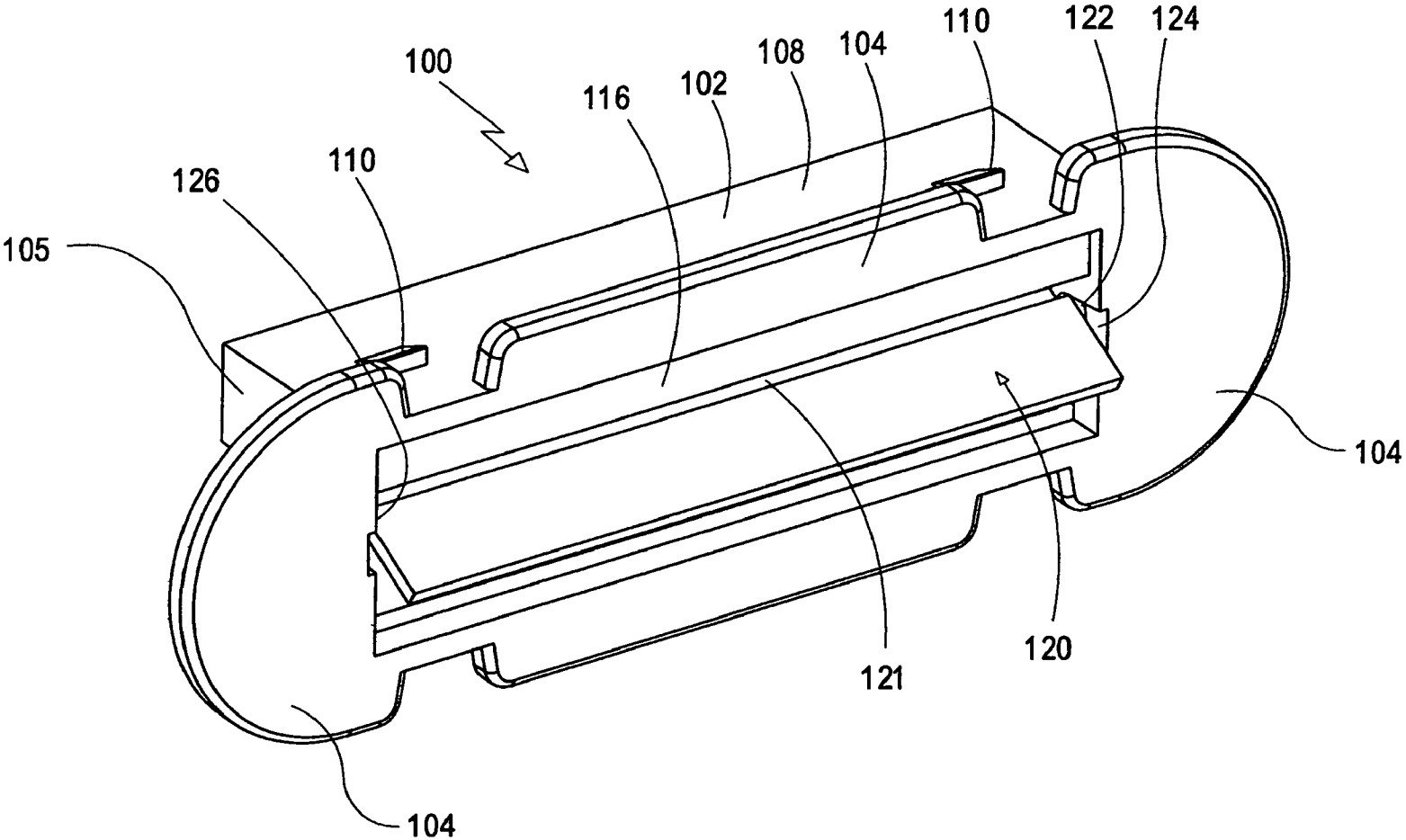
FIG. 12 is a front perspective view of a rectangular embodiment of the drain of the invention in a partially open position.
Figure 13:
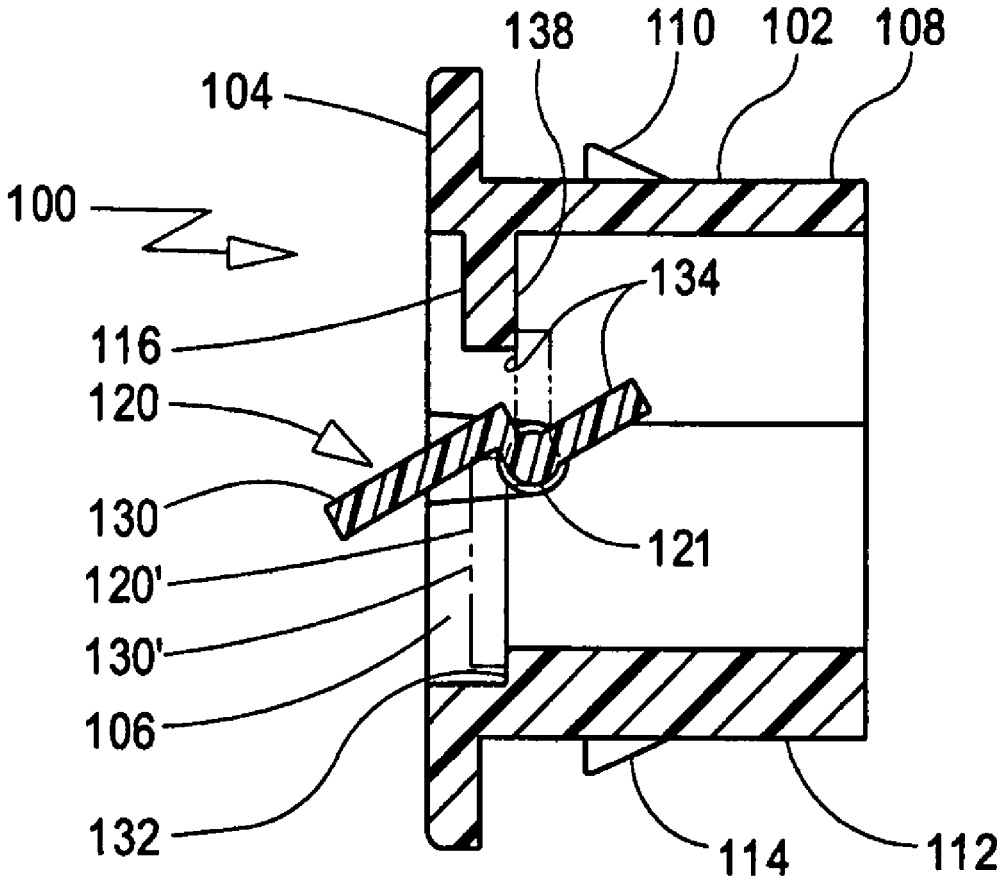
FIG. 13 is an enlarged vertical cross-section view of the embodiment shown in FIG. 12 in the open position.

FIGS. 12 and 13 illustrate another embodiment of water dram 100 having a rectangular housing 102 for installation in a rectangular hole formed by punching or muting in die thin wall of a sash. Drain 100 has a front cover wall or flange 104, formed in one or more sections, defining a drain opening 106. Flange 104 is formed integral with rectangular housing 102 such as by injection moulding of nylon plastic. Top wall 108 has an upstanding ribs 110 and lower wall 112 has downwardly depending ribs 114 for mounting the drain in the sash hole.

A baffle 116 depends downwardly from top wall 108 across opening 106 to partially block the upper portion thereof.

Rectangular flap 120 has a pivot axis 121 with cylindrical lugs 122 at opposite ends for pivotally mounting flap 120 in mating holes formed in opposed sides 124, 126 of housing 105. Flap 120 has a lower portion 130 mounted forwardly of pivot axis 121 adapted to close the lower portion of opening 106 by abutment against recessed edge 132, as depicted by numeral 130' in FIG. 13. The upper portion 134 of flap 120, extending radially upwardly from pivot axis 121, is adapted to abut the rear surface of baffle 116, as depicted by numeral 134'.

Figure 14:
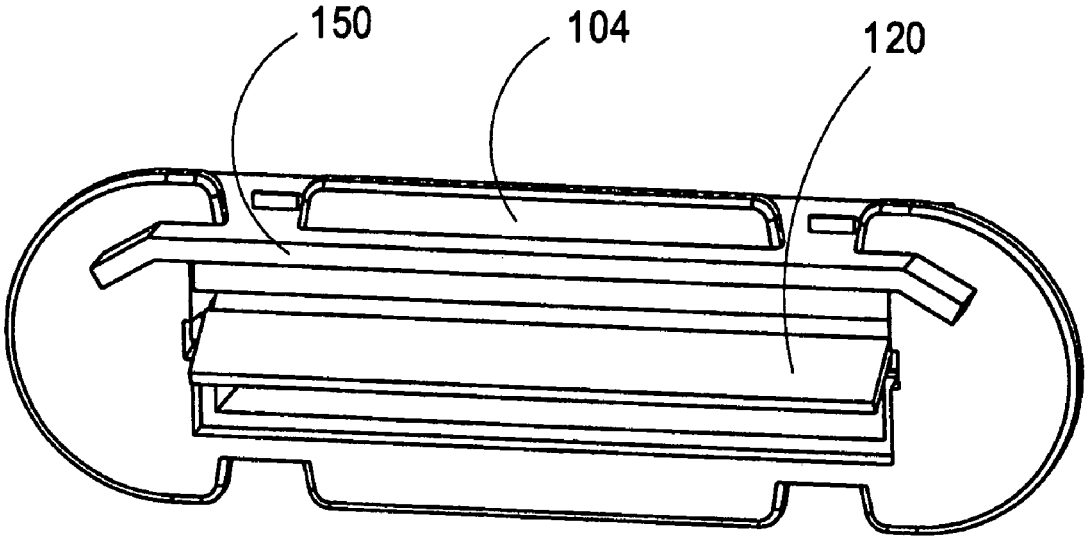
FIG. 14 is a perspective view of a rectangular embodiment of the invention having an extended front hood.
Figure 15:
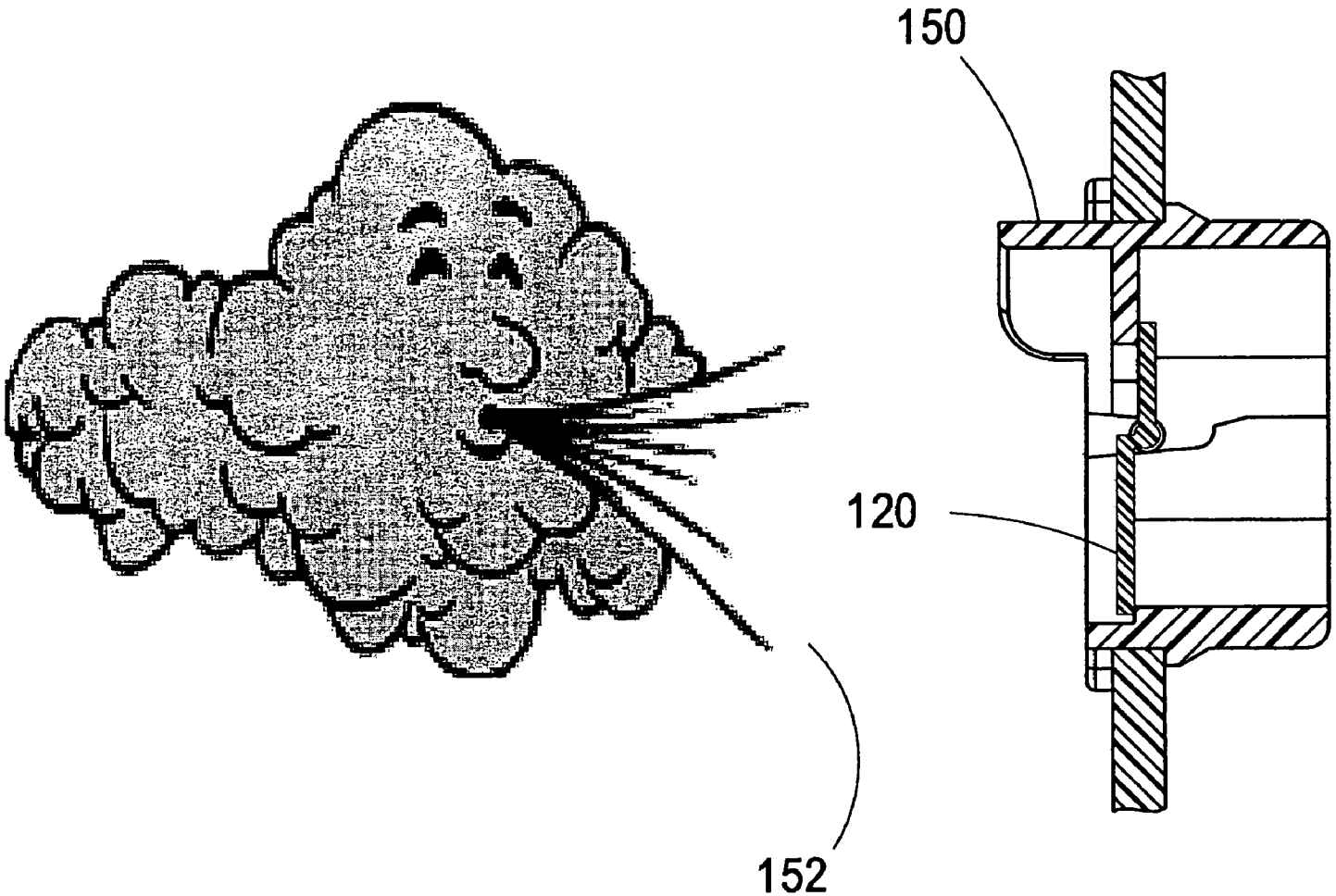
FIG. 15 is a vertical section of the embodiment shown in FIG. 14 in a closed position.
Figure 16:
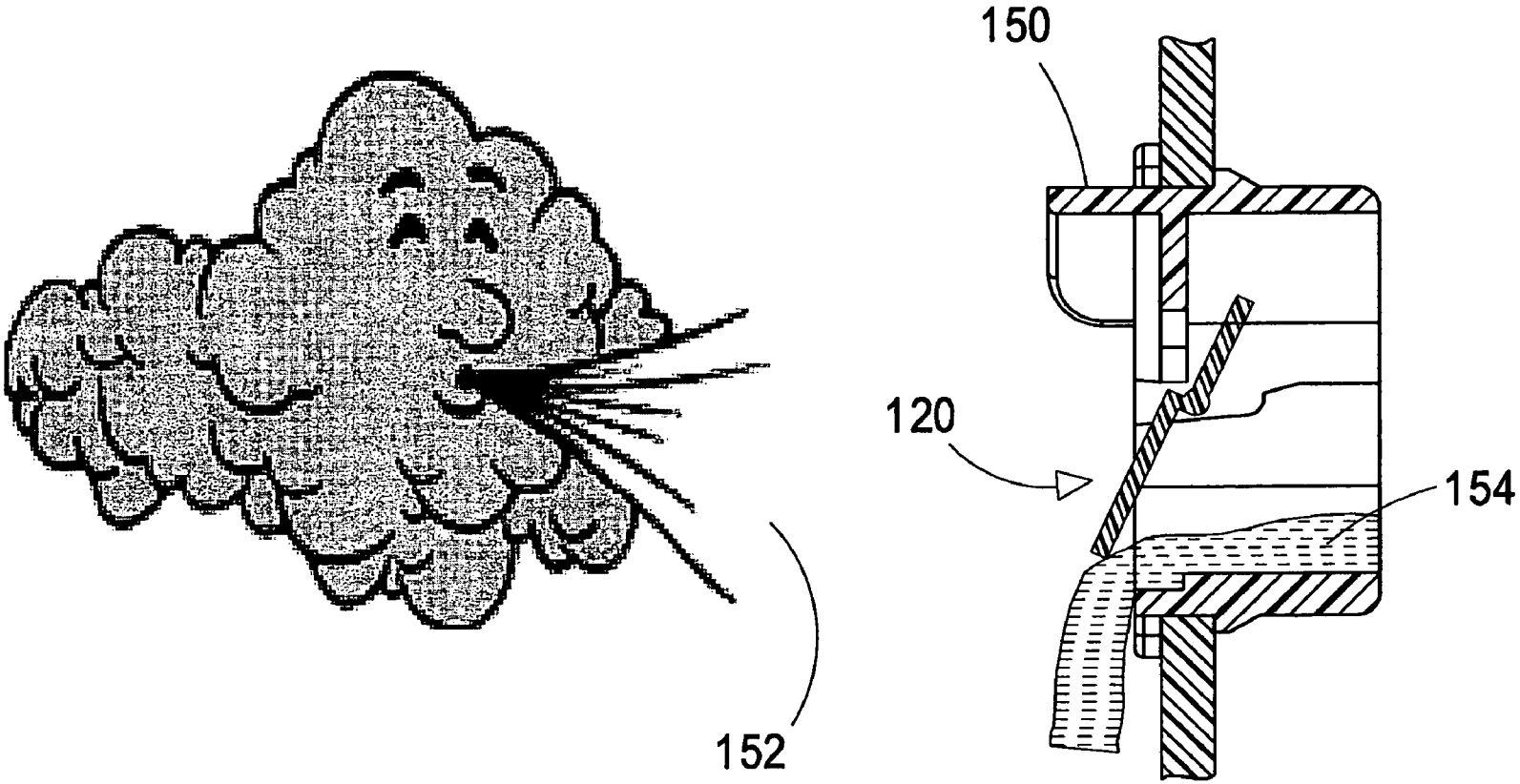
FIG. 16 is a vertical section of the embodiment shown in FIG. 14 in an open position.

FIGS. 14-16 illustrate a rectangular embodiment of the invention having a hood 150 extending forwardly from the upper portion of cover flange 104 to shield flap by diverting water therefrom which may flow down the external surface of the sash. FIG. 15 shows the flap 120 remaining in a vertical closed position notwithstanding the depiction 152 of a strong wind blowing against the flap. FIG. 16 shows opening of the flap against wind 152 to drain water 154 collected in the sash.

In operation, drain 100 mounted in a sash or flame assumes a normally at-rest closed position by gravity with flap 120 vertically disposed, as shown in FIG. 15 and by broken lines in FIG. 13, which the lower portion 130' of flap 120' abuts the forward recessed edge 132 of housing 102 and the upper portion 134' of flap 120' abuts the rear surface 138 of baffle 116. When pivoted to an open position as depicted in FIGS. 12, 14 and 16, to allow the escape of water, baffle 138 prevents the ingress of insects. Upon completion of drainage, flap 120 pivots by gravity to its closed position.

The drain of the present invention provides a number of important advantages. The drain is small and easy to install while providing a positive and trouble free operation, both in its closed substantially air-tight position and in its open water-drainage position. The drain flap does not stick in an open or closed position because of surface tension, notwithstanding its miniature size, which being able to open and close against the bias of a wind blowing on the drain.

It will be understood, of course that modifications can be made in the embodiment of the invention illustrated and described herein without departing from the scope and purview of the invention as defined by the appended claims.

The invention claimed is:

1. A water drain for insertion into a mating wall opening in an extruded, hollow door or window sash or frame, comprising:

a round or rectangular housing formed of a rigid plastics material having at least one peripheral front flange defining a drain opening for abutment against a wall of the sash or frame, said housing having a top portion and a bottom portion perpendicular to the front flange, and a pair of opposed side portions, a baffle extending downwardly from the housing top portion for partially closing an upper portion of the drain opening, means for securing the housing within the wall opening, comprising an elongated rib parallel to the front flange depending from each of the housing top and bottom portions for engaging the wall opening and a flap formed of a rigid plastics material having a lower planar rear surface in a lower flap portion and an upper planar front surface in an upper flap portion for opening and closing lower and upper portions of the drain opening, said planar lower flap portion surface being joined to the upper flap portion by a pivot axis, said lower flap portion being disposed forwardly of the upper flap portion whereby the flap tends to gravitate to an at-rest, closed, substantially vertical position, said flap having a lug extension at each end of the pivot axis for insertion into mating holes in said side portions of the housing for pivotal mounting of the flap in the housing drain opening, whereby the flap can pivot from a substantially vertical at-rest closed position to an open position, and a hood extending forwardly from an upper portion of the front flange for shielding the flap.

* * * * *